United States Patent [19]

Price

[11] 4,414,462

[45] Nov. 8, 1983

[54] TANK CAR HEATING SYSTEM

[75] Inventor: Albert E. Price, Bolingbrook, Ill.

[73] Assignee: General American Transportation Corporation, Chicago, Ill.

[21] Appl. No.: 284,460

[22] Filed: Jul. 17, 1981

[51] Int. Cl.[3] ..... B60L 1/02; H05B 3/00; B61D 5/00; F28D 1/06

[52] U.S. Cl. ..... 219/202; 105/358; 105/451; 219/311; 219/326; 126/343.5 R; 137/347; 137/350; 165/42; 165/104.19; 165/104.28; 165/104.31

[58] Field of Search ..... 105/358, 360, 451; 219/202, 311, 325, 326, 341; 126/343.5 R, 343.5 A, 378; 239/130, 131; 222/146 H, 146 HS, 146 HE; 137/341, 347, 350; 138/33; 237/12.3 B; 165/41, 42, 43, 44, 104.11, 104.19, 104.21, 104.22, 104.25, 104.28, 104.23, 104.31, 104.34, 104.23

[56] References Cited

U.S. PATENT DOCUMENTS

| | | | |
|---|---|---|---|
| 381,817 | 4/1888 | Ries | 219/202 |
| 462,926 | 11/1891 | Hunter | 307/9 |
| 1,503,972 | 8/1924 | Berg | 219/326 |
| 2,087,776 | 7/1937 | Morley | 123/425 |
| 2,332,149 | 10/1943 | Horton | 219/202 |
| 2,859,945 | 11/1958 | Kleist | 165/42 |
| 3,094,604 | 6/1963 | Van Der Sluys | 219/202 |
| 3,143,108 | 8/1964 | Rogers | 126/343.5 A |
| 3,280,301 | 10/1966 | Anderson | 219/320 |
| 3,286,079 | 11/1966 | Hynes | 219/310 |
| 3,359,971 | 12/1967 | Snelling | 126/343.5 A |
| 3,372,693 | 3/1968 | Gutzeit | 126/343.5 |
| 3,389,697 | 6/1968 | Giunta | 126/343.5 R |
| 3,681,566 | 8/1972 | Sellers | 126/343.5 A |
| 3,685,458 | 8/1972 | Price | 105/358 |
| 4,028,527 | 6/1977 | Thagard | 126/343.5 A |

*Primary Examiner*—B. A. Reynolds
*Assistant Examiner*—Teresa J. Walberg
*Attorney, Agent, or Firm*—Emrich & Lee and Brown, Hill, Dithmar, Stotland, Stratman & Levy

[57] ABSTRACT

A heated railway tank car includes heating conduits arranged on the tank and filled with a heating fluid and coupled to an electrically driven pump and heat exchanger in a closed-loop system for heating and continuously recirculating the heating fluid through the conduit. The tank car is adapted to be electrically interconnected with adjacent cars and the electric power may be provided from the locomotive, from an axle generator and alternator combination on the tank car, or from rechargeable batteries on the tank car charged by either terminal facilities or axle-mounted or locomotive-mounted generator means.

9 Claims, 6 Drawing Figures

FIG.3
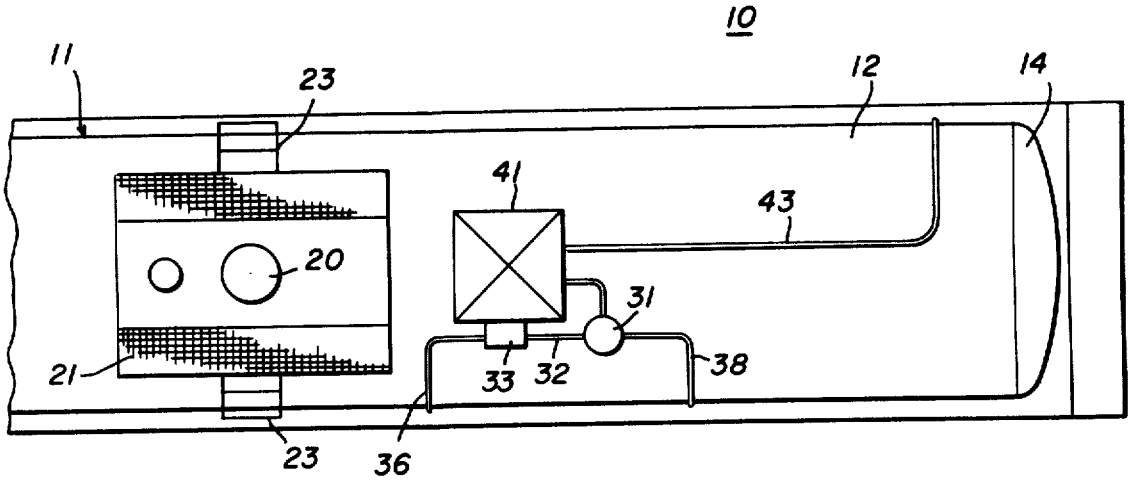
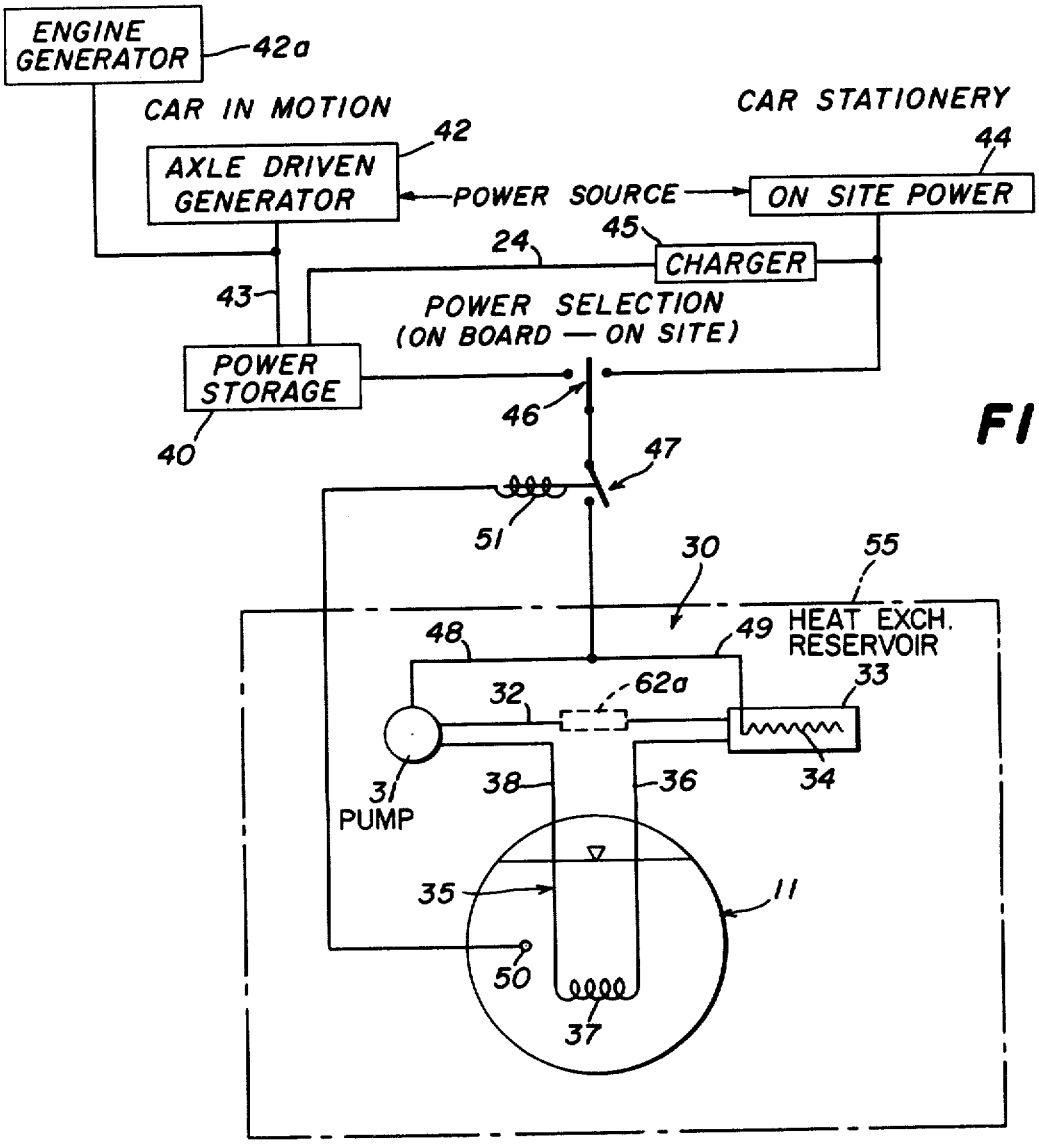
FIG.6

TANK CAR HEATING SYSTEM

BACKGROUND OF THE INVENTION

The present invention relates to tank vehicles such as railway tank cars and, in particular, to arrangements for heating the lading contained therein.

In order to provide heat necessary for the unloading of certain commodities shipped in railway tank cars, the tank cars are traditionally equipped with heater coils through which steam is introduced at an unloading rack until the proper commodity temperature for unloading is reached. Such an arrangement is disclosed in U.S. Pat. No. 3,685,458, issued Aug. 22, 1972, and assigned to the assignee of the present invention. That arrangement requires extensive steam facilities at the unloading terminal, and also requires considerable labor and time in connecting and disconnecting each car with respect to a steam line.

Another type of heating arrangement is disclosed in U.S. Pat. No. 3,286,079, issued Nov. 15, 1966, and includes elongated tubes extending longitudinally within the tank and in which are received long electrical resistance-type heating units. But this arrangement occupies valuable lading space within the tank, is of costly construction, and utilizes large amounts of electric power for energizing the long heating units which extend substantially the entire length of the tank. The long electrical heating units must be provided with special shock-absorbing mountings to prevent damage to the heating units from the sudden and often severe jolts and impacts commonly undergone by railway cars in use. While the arrangement is susceptible of energization from an onboard power source, an internal combustion engine is necessary for this purpose because of the large amounts of power which must be provided.

Another type of heating system powered by an onboard power source is disclosed in the U.S. Pat. No. 3,372,693, issued Mar. 12, 1968, and assigned to the assignee of the present invention. That system utilizes an onboard flameless combustion heater, the flue gases from which are passed through heating conduits on one end of the tank. But that system and all arrangements which utilize onboard combustion means suffer from serious practical drawbacks in terms of reliability and safety. More specifically, such systems are subject to mechanical failures in transit and typically require heavy maintenance. Furthermore, they require the provision of an onboard fuel supply, with the attendant risks of fuel leaks and accidental fire or explosion in the jarring environment of a railway car.

BRIEF SUMMARY OF THE INVENTION

The present invention relates to an improved tank car heating system which avoids the disadvantages of prior arrangements while affording additional structural and operating advantages.

It is an important object of this invention to provide a heating system for a tank vehicle which can be operated independently of terminal facilities.

In connection with the foregoing object, it is another object of this invention to provide a heating system of the type set forth which is of simple and economical construction and which is characterized by relatively low energy consumption.

It is another object of this invention to provide a heating system of the type set forth which is capable of being powered by onboard batteries.

Another object of this invention is to provide a heating system of the type set forth which is safe and reliable.

Still another object of this invention is the provision of a heating system for a railway tank car which is readily adaptable for being energized from an onboard power source, from terminal facilities or from adjacent cars.

These and other objects of the invention are attained by providing a heating system for a vehicle-mounted tank structure adapted to contain a liquid lading that is to be maintained in a heated condition, the heating system comprising electrically-powered pump means carried by the vehicle having a fluid inlet and a fluid outlet and adapted to be coupled to an associated source of electric power, heating conduit means carried by the tank structure and arranged to be in good heat exchange relationship with the lading contained therein, the conduit means interconnecting the fluid inlet and the fluid outlet of the pump means for cooperation therewith to form a closed loop, a heating fluid confined in the closed loop for recirculation therethrough by the pump means, and an electrically-powered heat source disposed in heat exchange relationship with the heating fluid in the conduit means and adapted to be coupled to the associated source of electric power for heating the heating fluid as it flows through the conduit means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

FIG. 3 is a fragmentary top plan view of the tank car of FIG. 2;

FIG. 6 is a schematic diagram of the heating system of the present invention.

DESCRIPTION OF THE PREFERRED EMBODIMENTS

Figure 1:
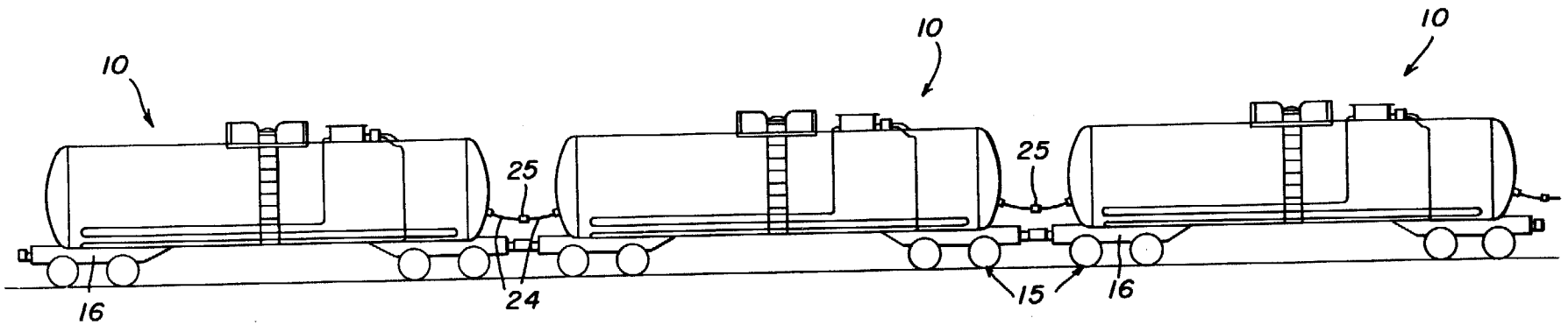
FIG. 1 is a side elevational view of a train of three interconnected railway tank cars, each having a heating system constructed in accordance with and embodying the features of a first embodiment of the present invention.
Figure 2:
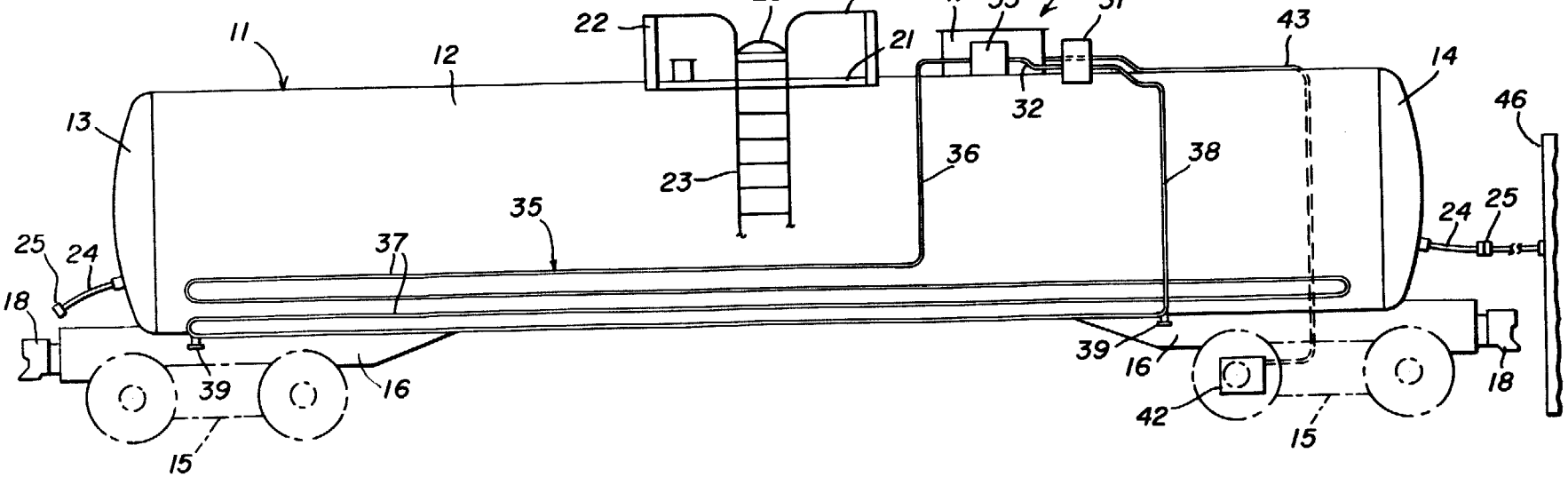
FIG. 2 is an enlarged side elevational view of one of the tank cars of FIG. 1.

Referring to FIG. 1 of the drawings, there is illustrated a train of three interconnected railway tank cars, each generally designated by the numeral 10. Referring also to FIG. 2 of the drawings, each tank car 10 includes a tank body, generally designated by the numeral 11 and including an elongated cylindrical side wall 12 closed at the opposite ends thereof respectively by convex end walls 13 and 14. The tank body 11 is supported adjacent to the opposite ends thereof by a pair of standard truck and wheel assemblies 15, each carrying a stub centersill 16 thereon. The stub centersills 16 are coupled to the tank body 11 by means of saddle bolster assemblies and reinforcing or bearing plate assemblies (not shown) in the usual manner. Each tank car 10 is also provided with a coupler 18 for coupling the tank car 10 to adjacent railway cars, all in a well-known manner.

The tank body 11 is provided with a dome section 20 extending upwardly from the top of the cylindrical side wall 12 intermediate the ends thereof, the dome section 20 being surrounded by a horizontal platform 21. The platform 21 is provided with guard rail structures 22 and access thereto is had by ladders 23 respectively extending downwardly therefrom along the opposite sides of the cylindrical side wall 12. Preferably, the tank car 10 is also provided with an electrical cable 24 which has free ends respectively extending from the opposite ends of the tank car 10 and each provided with a suitable connector 25 for connection to the adjacent end of a like cable on an adjacent railway car.

Referring now also to FIGS. 3 and 6 of the drawings, the tank car 10 is provided with a heating system, generally designated by the numeral 30, constructed in accordance with and embodying the features of a first embodiment of the present invention. The heating system 30 includes a pump 31 mounted on top of the tank body 11 and having one port thereof connected by a conduit section 32 to a heat exchange reservoir 33, also disposed on top of the tank body 11. Disposed in the heat exchange reservoir 33 is an electrical resistance heating element 34, which may be of the type sold by General Electric Company under the trademark CALROD. The conduit section 32 forms part of a conduit system, generally designated by the numeral 35, which also includes a feed section 36 coupled to the heat exchange reservoir 33 and extending downwardly along the side of the cylindrical side wall 12 and communicating with one end of an elongated heating coil section 37 which extends longitudinally of the cylindrical side wall 12 along the bottom portion thereof. The other end of the heating coil section 37 communicates with a return section 38 which extends upwardly along the cylindrical side wall 12 to the other port of the pump 31 for completing a closed loop. While a sinuous arrangement is shown, it will be appreciated that the heating coil section 37 may have other arrangements, two such other arrangements being disclosed in U.S. Pat. Nos. 3,595,307 and 3,685,458. The heating coil section 37 may be provided with one or more drains 39 along the lowermost portion thereof, each having suitable removable closure means.

There is also provided power storage means 40, which preferably comprises one or more rechargeable batteries (not shown), and which is also mounted on top of the cylindrical side wall 12 in a housing 41. If desired, recharging of the batteries may be accomplished by an axle generator 42 mounted on one of the trucks 15, or by a generator 42A in the engine of the train (see FIG. 6), either generator being connected to the batteries by a conductor 43. The batteries may also be charged from an on-site electric power supply 44 located at a terminal facility and connected through a suitable charger 45 to the onboard electrical cable 24, which is in turn connected to the batteries. The charger 45 may be carried onboard the tank car 10 or may be located at the terminal facility.

The power storage means 40 is also connected to one of the fixed contacts of a single-pole double-throw switch 46, the other fixed contact of which is adapted for connection to the on-site power supply 44. The movable contact of the switch 46 is connected to the movable contact of a single-pole single throw switch 47, the fixed contact of which is connected through a conductor 48 to the pump 31 and through a conductor 49 to the heating element 34. A thermostatic temperature probe 50 is disposed within the tank body 11 for sensing the temperature of the liquid lading therein, the temperature probe 50 being electrically connected to a solenoid 51 for controlling the operation of the switch 47. Preferably, the entire heating system 30 and the tank body 11 are provided with suitable thermal insulation (diagrammatically illustrated at 55 in FIG. 6).

In operation, the conduit system 35 is filled with a suitable heating fluid which is preferably an oil similar to that used in cooling high-voltage transformers. The heating fluid is confined within the closed loop system defined by the conduit system 35, the heat exchange reservoir 33 and the pump 31 and is continuously recirculated therethrough by the pump 31. As the heating fluid passes through the heat exchange reservoir 33 it is heated by the heating element 34 which is disposed in heat exchange relationship with the heating fluid. The pump 31 and the heating element 34 are both energized through the switches 46 and 47 either from the on-site power supply 44 or, when the tank car 10 is in motion or is located at a place where on-site power is unavailable, from the power storage means 40. The on-site or onboard power sources may be selected by actuation of the switch 46 between its two positions, which actuation may be either manual or automatic.

Figure 4:
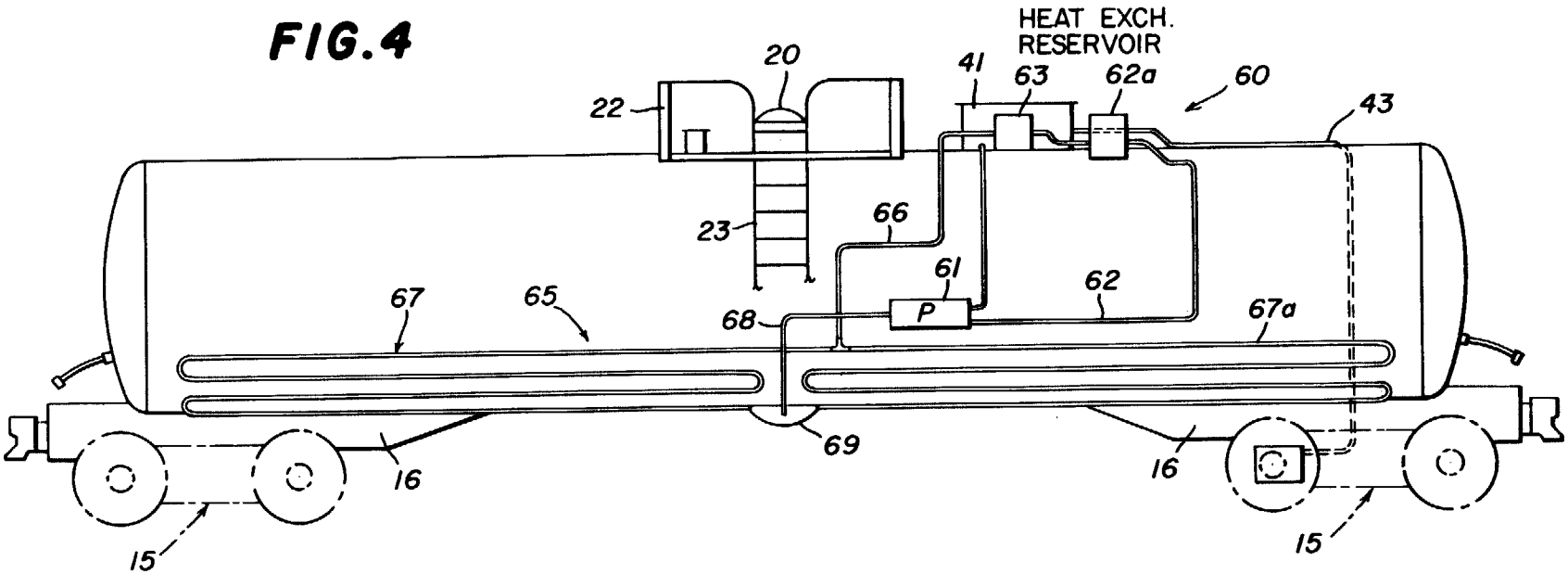
FIG. 4 is a view similar to FIG. 2 of a second embodiment of the present invention.
Figure 5:
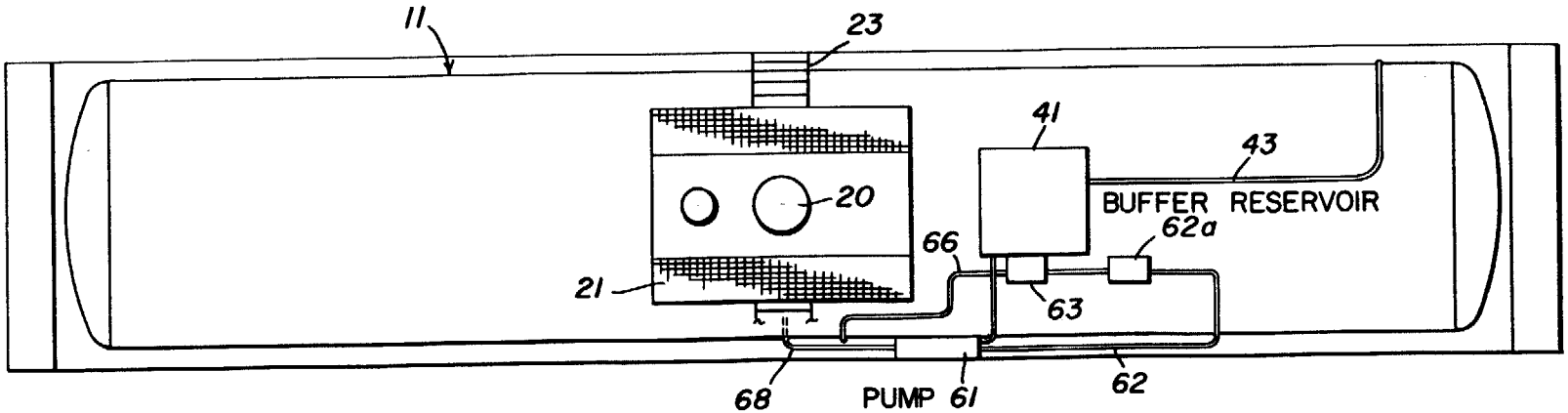
FIG. 5 is a view similar to FIG. 3 of the embodiment of FIG. 4.

Referring now to FIGS. 4 and 5 of the drawings, there is illustrated an alternative embodiment of the heating system of the present invention, generally designated by the numeral 60, which is essentially the same as the heating system 30, except that the heating fluid used is steam and, accordingly, slight modifications have been made to accommodate this different type of heating fluid. Corresponding parts of the heating systems 30 and 60 have been given corresponding numbers in the 30 and 60 series, respectively.

The heating system 60 includes a pump 61 mounted on the tank body 11 and having one port thereof connected by a conduit section 62 through a buffer reservoir **62*a* to a heat exchange reservoir 63, both of which reservoirs are preferably disposed on top of the tank body 11. The heat exchange reservoir 63 is in the form of an electrically-powered boiler having electrical resistance heating elements (not shown). The conduit section 62 forms part of a conduit system, generally designated by the numeral 65, which also includes a feed section 66 coupled to the heat exchange reservoir 63 and extending downwardly along the side of the cylindrical side wall 12 and communicating with the two halves 67 and 67*a* of an elongated sinuous heating coil section which extends longitudinally of the cylindrical side wall 12 along the bottom portion thereof. The other ends of the sinuous heating coil section halves 67 and 67*a* terminate in a sump 69, which in turn communicates with a return conduit section 68 which extends upwardly along the cylindrical side wall 12 to the other port of the pump 61 for completing a closed loop. The sump 69** may be provided with a drain (not shown).

The operation of the heating system 60 and its connection to the power storage means 40 is substantially the same as was described above for the heating system 30. Indeed, a schematic diagram of the heating system 30 may be obtained by simply substituting numbers in the 60 series for corresponding numbers in the 30 series in FIG. 6, it being understood that the buffer reservoir 62*a* would be inserted in the conduit section 32 between the pump 31 and the heat exchange reservoir 33. The only difference in operation is that the steam condenses as it gives up its heat to the lading in the tank body 11, the condensate being collected in the sump 69. Accordingly, it will be understood that the pump 61 is moving a liquid condensate from the sump 69 to the heat exchange reservoir 63. The heat exchange reservoir 63 boils the condensate and provides steam to the heating coil section halves 67 and 67*a* via the feed section 66.

As the heated heating fluid flows through the heating coil sections of the conduit systems 35 or 65, it exchanges its heat with the lading in the tank body 11. It is a significant feature of the present invention that, since the heating systems 30 and 60 are not required to rapidly heat up a cooled tank, but are rather required only to maintain the temperature of a preheated lading, and further since the heat exchange reservoirs 33 and 63 are only required to heat a relatively small volume of heating fluid as it is flowing therethrough, therefore the power requirements of the heating systems 30 and 60 are minimal and can be readily supplied by a rechargeable onboard battery.

It is another significant aspect of the present invention that the heating systems 30 and 60 are extremely flexible in terms of the power source to be used therewith. Since the tank cars 10 may be electrically interconnected via the electrical cables 24 and connectors 25, the electric power for operating the pumps 31 and 61 and the heating elements in the heat exchange reservoirs 33 and 63 may be provided from a generator on the locomotive. Alternatively, the axle generator 42 could be used with an alternator (not shown) on each tank car 10 for powering the pumps 31 and 61 and the heating elements in the heat exchange reservoirs 33 and 63 without the use of batteries. Finally, the arrangement illustrated in FIG. 4 may be utilized, wherein storage batteries are provided on each tank car 10 and are charged by either terminal electricity or an axle-mounted or locomotive-mounted generator. Since the tank cars 10 may be electrically interconnected, the batteries on all of the cars 10 in a train may be charged by connecting only one of them to an on-site power source at a terminal facility. It will also be appreciated that the batteries on each car can be individually charged or, if no batteries are used, electric power can be supplied directly to each car individually at a terminal.

By opening the drains 39 or the drain in the sump 69, the heating fluid can be drained from the heating systems 30 and 60 for cleaning, servicing and the like. Also, when the heating fluid has been removed from the heating systems 30 and 60, the drains can be used as inlets for applying steam to the conduit systems 35 and 65 and using them as conventional steam heating systems.

From the foregoing, it can be seen that there has been provided an improved closed-loop heating system for a tank vehicle which is of simple and economical construction, characterized by low power consumption, capable of being powered by onboard storage batteries or by terminal power sources, and extremely safe and reliable.

What is claimed is:

1. A heating system for the tank structure of a railway tank car adapted to contain a liquid lading that is to be maintained in a heated condition, said heating system comprising electrically-powered pump means carried by the tank car, said pump means having a fluid inlet and a fluid outlet and adapted to be coupled to an associated source of electric power, heating conduit means interconnecting the fluid inlet and the fluid outlet of said pump means for cooperation therewith to form a closed loop, said conduit means including a reservoir portion and an elongated sinuous heating portion disposed along the outside of the bottom of the associated tank structure and arranged to be in good heat exchange relationship with the lading contained therein, a heating fluid confined in said closed loop for recirculation therethrough by said pump means, a heat source consisting solely of a resistance-type electric heater disposed in said reservoir portion of said conduit means in heat exchange relationship with said heating fluid and adapted to be coupled to the associated source of electric power for heating said heating fluid as it flows through said conduit means, and thermostatic control means coupled to said pump means and to said heat source for automatic deactuation of both said pump means and said heat source in response to elevation of the temperature of the liquid lading above a predetermined temperature.

2. The heating system of claim 1, and further including rechargeable battery means carried by the associated vehicle and coupled to said pump means and to said heat source for providing electrical power thereto.

3. The heating system of claim 1, wherein said control means includes switch means movable between a normally-closed position for connecting said pump means and said heat source to the associated source of electric power and an open condition for disconnecting said pump means and said heat source from the associated source of electric power, and means for moving said switch means to the open condition thereof in response to elevation of the temperature of the liquid lading above a predetermined temperature.

4. The heating system of claim 1, wherein said conduit means includes drain means for removing said heating fluid therefrom.

5. A heated railway tank car comprising a mobile frame, tank structure carried by said frame and adapted to contain a liquid lading that is to be maintained in a heated condition, electrically-powered pump means carried by said frame, said pump means having a fluid inlet and a fluid outlet and adapted to be coupled to an associated source of electric power, heating conduit means carried by said tank structure and interconnecting the fluid inlet and the fluid outlet of said pump means for cooperation therewith to form a closed loop, said conduit means including a reservoir portion and an elongated sinuous heating portion disposed along the outside of the bottom of the associated tank structure and arranged to be in good heat exchange relationship with the lading contained therein, a heating fluid confined in said closed loop for recirculation therethrough by said pump means, a heat source consisting solely of a resistance-type electric heater disposed in heat exchange relationship with said heating fluid in said reservoir portion of said conduit means and adapted to be coupled to the associated source of electric power for heating said heating fluid as it flows through said conduit means, and thermostatic control means coupled to said pump means and to said heat source for automatic deactuation of both said pump means and said heat source in response to elevation of the temperature of the liquid lading above a predetermined temperature.

6. The railway tank car of claim 5, and further including means for electrically connecting said car to adjacent railway cars in a train.

7. The railway tank car of claim 5, wherein said mobile frame includes a rotatable axle and wheels mounted thereon, and an electrical generator coupled to and driven by said axle when said vehicle is in motion and coupled to said pump means and to said heat source for providing electrical power therefor.

8. The railway tank car of claim 5, and further including rechargeable battery means carried by said frame and connected to said pump means and to said heat source for providing electrical power thereto.

9. The railway tank car of claim 8, wherein said mobile frame includes a rotatable axle and wheels mounted thereon, and an electrical generator coupled to and driven by said axle when said vehicle is in motion and coupled to said battery means for recharging thereof.

* * * * *